US007752831B2

(12) United States Patent
Balboul et al.

(10) Patent No.: US 7,752,831 B2
(45) Date of Patent: Jul. 13, 2010

(54) SYSTEM FOR ACTIVATING A ROTOR DRIVE OF AN OPEN-END ROTOR SPINNING MACHINE

(75) Inventors: Nour-Eddine Balboul, Cologne (DE); Sven Meerkamp, Viersen (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 147 days.

(21) Appl. No.: 12/228,640

(22) Filed: Aug. 14, 2008

(65) Prior Publication Data

US 2009/0049819 A1 Feb. 26, 2009

(30) Foreign Application Priority Data

Aug. 25, 2007 (DE) ..... 10 2007 040 216

(51) Int. Cl.
*D01H 13/26* (2006.01)

(52) U.S. Cl. ..... 57/264; 57/404

(58) Field of Classification Search ..... 57/264, 57/265, 404; 700/139
See application file for complete search history.

(56) References Cited

U.S. PATENT DOCUMENTS

| | | | | |
|---|---|---|---|---|
| 5,519,636 | A * | 5/1996 | Stoll et al. | 700/282 |
| 6,574,526 | B1 | 6/2003 | Gaukler et al. | 700/139 |
| 7,392,648 | B2 * | 7/2008 | Biermann et al. | 57/264 |

FOREIGN PATENT DOCUMENTS

EP 1 054 086 A1 11/2000

* cited by examiner

*Primary Examiner*—Shaun R Hurley
(74) *Attorney, Agent, or Firm*—K&L Gates, LLP

(57) ABSTRACT

A system for activating a rotor drive (31) of an open-end rotor spinning machine (30), having an open-end rotor spinning machine (30) with a plurality of workstations (33), each having a rotor drive (31) with a control unit (4), which comprises at least one communication interface (18, 19) for connecting to a workstation control unit (35), and external means for substitute activation of the individual rotor drives (31) and for reading signals representing operating state data of the rotor drive from the individual control units (4) of the rotor drives (31) by means of at least one communication interface (18, 19) of the control units (4) for adjustment and checking purposes.

11 Claims, 2 Drawing Sheets

SYSTEM FOR ACTIVATING A ROTOR DRIVE OF AN OPEN-END ROTOR SPINNING MACHINE

CROSS-REFERENCES TO RELATED APPLICATIONS

This application claims the benefit of German patent application 10 2007 040 216.5, filed Aug. 25, 2007, herein incorporated by reference.

BACKGROUND OF THE INVENTION

The present invention relates to a system for activating a rotor drive of an open-end rotor spinning machine.

A rotor spinning machine is known from the document European Patent Document EP 1 054 086 B4, which has a plurality of spinning stations. The individual spinning stations of a rotor spinning machine of this type comprise a rotor drive with a control unit, which has a communication interface for connecting to a spinning station control unit by means of a line system or bus system, which automatically controls the work sequence at the spinning stations. The data required for this are transmitted by means of a central main control unit of the rotor spinning machine, which, using a communication protocol, sends corresponding control data by means of the bus system to the spinning station control units.

The drawback of rotor spinning machines of this type is that the individual rotor drives, in the installed state and during operation, cannot be checked with regard to their state for maintenance purposes. A check of this type instead requires the dismantling of the individual rotor drives from the rotor spinning machine.

SUMMARY OF THE INVENTION

The present invention is therefore based on the object of facilitating the checking of rotor drives of an open-end rotor spinning machine for maintenance purposes.

This object is achieved according to the invention by a system for activating a rotor drive of an open-end rotor spinning machine. The system according to the invention for activating a rotor drive of a rotor spinning machine comprises an open-end rotor spinning machine with a plurality of workstations, which in each case have a rotor drive with a control unit. The individual control units of the rotor drives in this case comprise at least one communication interface for connecting to a workstation control unit. According to the invention, the system comprises external means for substitute activation of the individual rotor drives and for reading signals representing operating state data of the rotor drive from the control units of the individual rotor drives by means of at least one communication interface of the control units for adjustment and checking purposes. Preferred embodiments of the invention are described more fully hereinbelow.

These external means according to the invention, in conjunction with the at least one communication interface of the control unit, allow the rotor drive to be checked for maintenance purposes without having to dismantle it from the rotor spinning machine. Maintenance work on the individual rotor drives is substantially facilitated thereby.

In a preferred embodiment of the invention, the external means comprise a computer unit with a communication interface for connecting to one of the communication interfaces of the control units. The computer unit is used here, on the one hand, for communication with the rotor drive and, on the other hand, for evaluation and display of the information and signals determined. To ensure this, in an advantageous configuration of the invention, the computer unit can be formed by one of the following units: a notebook, a workstation, a microcontroller, a digital signal processor (DSP) or a field programmable gate array (FPGA). However, the use of a microcomputer, such as, for example, a PDA (personal digital assistant), which can be carried by a fitter at any time and can be connected to the control unit of a rotor drive of the spinning machine according to the invention, is also advantageous. However, a mobile computer unit specifically tailored to the maintenance of the individual workstations is basically also conceivable. The advantage on which a computer unit of this type is based comes from the mobility and the flexibility resulting therefrom.

In a further preferred embodiment of the invention, the computer unit comprises an application programme as the means for substitute activation of the individual rotor drives and for reading out signals representing the operating state of the rotor drive from the control units of the individual rotor drives by means of the individual communication interfaces of the control units and the communication interface of the computer unit independently of the open-end rotor spinning machine. The individual communication interfaces of the control units, which are normally connected to the main control unit of the rotor spinning machine are preferably designed here as standard serial interfaces.

Using a communication protocol, by way of example, individual rotational speeds or defined rotational speed profiles can be input by means of the application programme to run up the individual rotor drives to check the state thereof by means of the individual communication interfaces of the control units and the communication interface of the computer unit. The measured time required to accelerate a defined mass moment of inertia of a unit associated with the rotor drive to a predetermined rotational speed can be used as a criterion to assess the state of the individual rotor drives. The application programme contains corresponding driver modules which allow signals to be read out from the individual control units using the communication protocol. Thus the standard serial communication interfaces of the individual control units do not only act as activation interfaces, but also as interfaces capable of diagnosis by means of which the signals of all the components communicating with the individual control units can be read out for checking purposes, for example the signals of a box lock of the rotor spinning machine. These signals can then be displayed on display means of the computer unit for assessing the state of the individual components. In a simplified configuration, only the output signals of the components are monitored, the output signals detected being converted by means of an A/D converter into digital signals and it then being possible to read them out via the interface of the individual control units.

The communication interface of the computer unit can be connected to one of the communication interfaces of the control units here simply and economically by means of a cable. Cables of this type have a high data transmission rate, so complete and rapid communication of the computer unit with the control unit is ensured at all times. A number of application programmes running in parallel can also communicate in parallel with the control unit without bottlenecks occurring in the data transfer. Alternatively to this, these communication interfaces may also basically be configured as interfaces which can be wirelessly connected to one another, for example as infrared interfaces or radio interfaces. Wireless connections have the advantage that at any time a communication of the computer unit with the control unit of the rotor drive is possible without a cable needing to be replugged. A technician could thus move from rotor drive to rotor drive when checking a spinning machine and in each case enter individually into communication with the control unit thereof by means of his PDA. This type of configuration of interfaces in particular has the advantage that no environmental influences, such as dirt or dust can influence the communication interfaces and therefore the communication of the control unit with the computer unit.

The communication interfaces of the individual control units are preferably configured as synchronous or asynchronous interfaces such as, for example as a UART (universal asynchronous receiver transmitter) interface, which allow a selection of different communication protocols.

In order to convert notebooks or PDAs already in operation to the external computer units according to the invention, in a further advantageous configuration, the communication interface may also be arranged on an insertion card. Insertion cards of this type can be installed retrospectively into the computer units and allow communication with the control unit. Conceivable insertion cards should be configured as PCMCIA (personal computer memory card international association) or PCI (peripheral component interconnect) cards. So-called USB converters, for example USB to RS485, can also be used to connect the external computer unit. The described standards allow easy and unproblematical integration of the communication interface according to the invention into already existing computer hardware.

In particular, the control unit of the rotor drive may have a first communication interface and a second communication interface, which are coupled to one another in such a way that on connection of the external computer unit to the second communication interface, the first communication interface can be deactivated. The second communication interface allows connection of the external computer unit without having to interrupt the communication flow between the control unit and the rotor drive. Thus, the rotor drive can continue to be activated by means of the control unit while instantaneous operating state data can be read out by means of the second communication interface or the control unit of the rotor drive can be operated in debugging mode. However, as an alternative, the first communication interface, to which the control unit is connected, can be deactivated, so the rotor drive is activated by means of the external computer unit connected to the second communication interface. For deactivation, it may be provided that the first communication interface can be deactivated already with the direct connection of the external computer unit to the second communication interface. Likewise, the deactivation can be carried out by the application present on the external computer unit so a switchover can be made between a debugging mode and the simulation of operation of the workstation.

BRIEF DESCRIPTION OF THE DRAWINGS

An embodiment of the invention will be shown in detail below with reference to two drawings, in which.

DETAILED DESCRIPTION OF THE PREFERRED EMBODIMENTS

Figure 1:
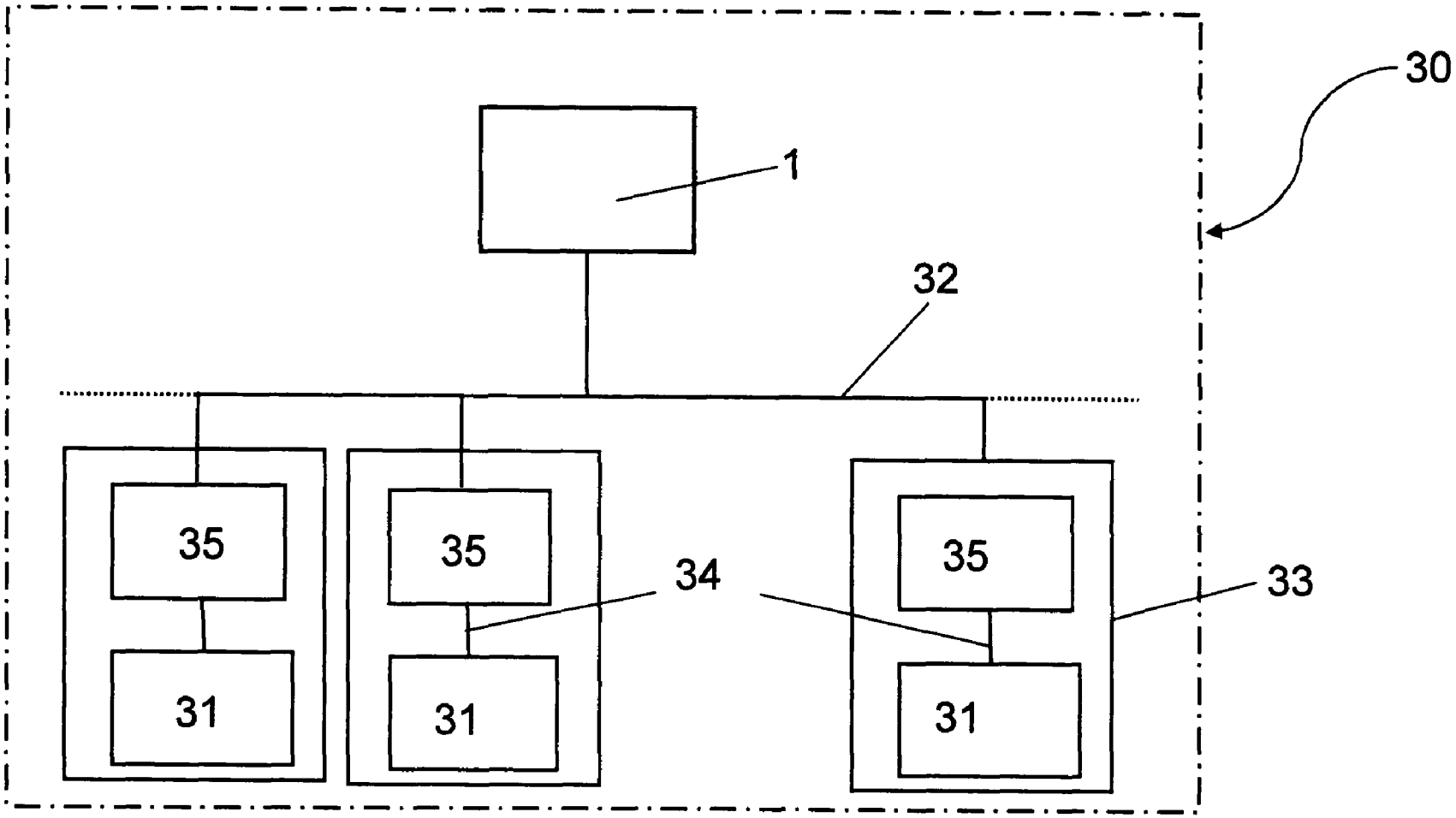
FIG. 1 shows a schematic view of a rotor spinning machine with a plurality of spinning stations which in each case have a rotor drive.
Figure 2:
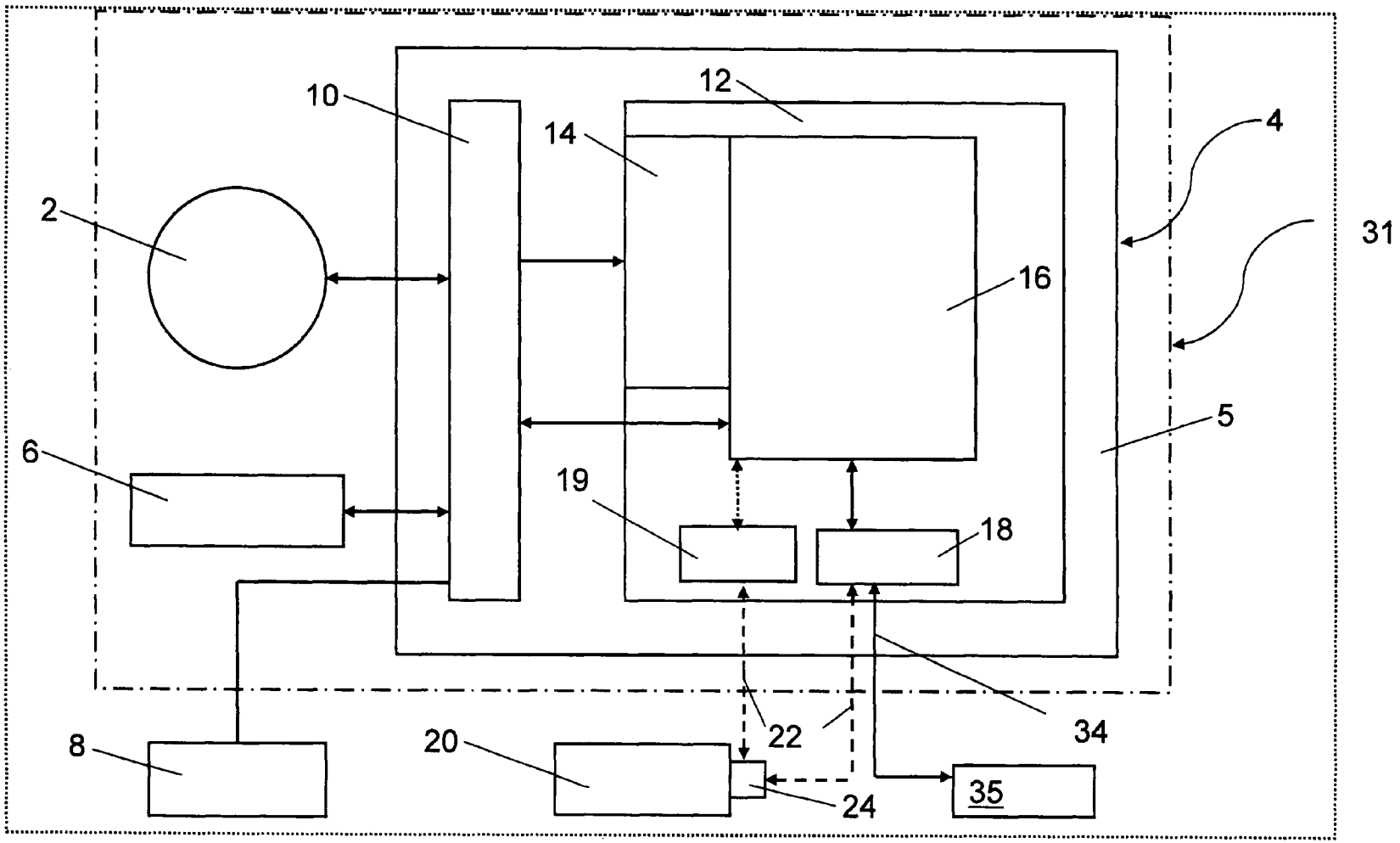
FIG. 2 shows a schematic view of a system according to the invention for substitute activation of one of the rotor drives shown in FIG. 1 for adjustment and checking purposes.

The rotor spinning machine 30 shown schematically in FIG. 1 comprises a plurality of spinning stations 33, which in each case have a rotor drive 31 as shown in FIG. 2 with a control unit 4, and a central main control unit 1, which is connected by means of a bus system 32, such as a CAN Bus, to spinning station control units 35 of the respective spinning stations 33. The spinning station control units 35 are connected to the respective control units 4 of the rotor drives 31 by means of a line system 34. Using a communication protocol, the main control unit 1 transmits control messages with corresponding control data to the individual spinning station control units 35 of the spinning stations 33.

The system according to the invention shown in FIG. 2 for activating the rotor drives 31 shown in FIG. 1 of the rotor spinning machine 30 comprises a notebook as the external computer unit 20, which can be connected as a substitute to one of the control units 4 of the rotor drives 31 for adjustment and checking purposes. The rotor drive 31 comprises an electric motor 2, which drives a rotor preferably contactlessly mounted by means of a magnetic bearing 6, and a control unit 4 with a preferably standard serial communication interface 18 for connecting to the spinning station control unit 35. Apart from the rotor drive 31, diverse other components of the associated spinning station 33 also communicate with the spinning station control unit 35, for example a yarn quality testing unit not shown here.

The control unit 4 comprises a main printed circuit board 5, on which a microcontroller 12 or a digital signal processor (DSP) is arranged. Electric components, sensors and actuators, which are indicated as such by the reference numeral 10, are connected to the main printed circuit board 5. The current specification for activating the rotor drive 31, the rotational speed control of the rotor drive 31, the specification of currents and/or voltages for, diverse other components connected to the control unit 4 and their signal detection belong to the tasks of the microcontroller 12. Contained in the microcontroller 12 is a control programme 16 with corresponding control data, which communicates with the electric components 10. Also implemented in the microcontroller 12 is the communication interface 18 of the control unit 4, preferably as a UART (universal asynchronous receiver transmitter) interface or as a RS485 interface. The signals generated by the electric components 10 are supplied by means of an A/D converter 14 arranged on the microcontroller 12 to the control programme 16. The voltage supply of the rotor drive 31 is indicated by the reference numeral 8.

The external computer unit 20 can be connected by means of an interface 24, preferably by means of a cable 22, to the standard serial communication interface 18 of the control unit 4, the spinning station control unit 35 being separated from the control unit 4. Basically, the communication interface 18 of the control unit 4 and the interface 24 of the external computer unit 20 can also be designed as interfaces which can be wirelessly connected to one another, for example as infrared interfaces or radio interfaces. The computer unit 20 contains an application programme, with which using a communication protocol, the rotor drive 31 can be activated or can be operated as a substitute for adjustment and checking purposes independently of the rotor spinning machine 30 or the spinning station control unit 35 by means of the communication interface 18 and the interface 24 and signals can be read out from the control unit 4 of the rotor drive 31 by means of the communication interface 18 and the interface 24. Corresponding driver modules in the application programme in this case allow, according to the invention, the reading out of signals from the control unit 4 by means of the standard serial communication interface 18, so the latter functions according to the invention as an interface capable of diagnosis, or a diagnostic interface as an integrated component thereof.

Alternatively, the rotor drive 31 may have a second communication interface 19, to which the external computer unit 20 can be connected. The second communication interface 19 may be designed, like the first communication interface 18, as a serial interface, for example as an RS485 interface. By connecting the external computer unit 20 to the second communication interface 19, the first communication interface 18 can be deactivated to decouple the rotor drive 31 in the installed state from the spinning station control unit 35. The first interface 18 may be deactivated automatically here on the connection of the external computer unit 20 to the second interface 19 or by a targeted activation of the control unit 4 of the rotor drive 31 by the connected computer unit 20. The latter allows the external computer unit 20 to be connected for pure interrogation and debugging purposes, the communication between the rotor drive 31 and the control unit 35 not being interrupted and it being possible to read out detected instantaneous values or information from the rotor drive 31 detected in a fault memory. On deactivation of the first communication interface 18, the external computer unit 20 takes over the activation of the rotor drive 31 instead of the spinning station control 35.

According to the invention, the computer unit 20 in conjunction with the first communication interface 18 or the second communication interface 19 of the control unit 4 allows the rotor drive 31 to be checked with regard to its state, without it having to be dismantled for this purpose from the rotor spinning machine 30. For this purpose, the functioning of the spinning station control unit 35 is observed by the computer unit 20, in other words, the computer unit 20 sends signals for starting and stopping the rotor drive 31 or manual spinning box unlocking. The application on the external computer unit 20 for this purpose simulates various operating states. Furthermore, individual rotational speeds or defined rotational speed profiles, by means of which the state of the rotor drive 31 can be assessed, can be input into the control unit 4 by means of the computer unit 20. The measured time required to accelerate a defined mass moment of inertia of the rotor unit of the rotor drive 31 to a predetermined rotational speed can be used, for example, as a criterion for assessing the state of the rotor drive 31.

A further aspect in this context is the checking of the bearing adjustments of the rotor drive 31, the adjustments of the magnetic bearing 6 here, by means of sensors installed in the magnetic bearing 6, which communicate with the control unit 4 of the rotor drive 31. The signals detected by the control unit 4, of the axial bearing sensors relate to the position of the rotor in the magnetic bearing 6 and can be read out by means of the computer unit 20 from the control unit 4 by means of the communication interfaces 18, 19 of the control unit 4 and the interface 24 of the external computer unit 20 for adjustment purposes and displayed by the computer unit 20. The external computer unit 20 allows an operator to adjust the bearing even before being put into operation for the first time, without the spinning station 33 itself having to be put into operation. The adjustment is simplified by using a suitable application which converts the data detected and visually displays them.

Using the external means of the system according to the invention in conjunction with one of the communication interfaces 18 or 19 of the control unit 4, the signals of the rotor drive 31 can be read out for the checking thereof and can be displayed or adjustments can be carried out in this context, it being possible to carry this out both during operation of the rotor drive 31, with the spinning station control unit 35 active or deactivated and also directly after the production of the rotor drive 31 independently of the rotor spinning machine 30.

As a result, adjustment and maintenance work on the individual spinning stations 33 of the rotor spinning machine 30 are therefore suitably facilitated as a whole by the system according to the invention.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. System for activating a rotor drive (31) of an open-end rotor spinning machine (30), comprising an open-end rotor spinning machine (30) with a plurality of workstations (33), each of the work stations (33) having a rotor drive (31) with a rotor drive control unit (4) comprising at least one communication interface (18, 19) for connecting to a workstation control unit (35), and means disposed externally of and not physically connected with the spinning machine (30) and selectively operative to connect to any of the rotor drive control units (4) in selective substitution of the workstation control units (35) for activation of the individual rotor drives (31) and for reading signals representing operating state data of the rotor drives from the individual rotor drive control units (4) of the rotor drives (31) by means of the at least one communication interfaces (18, 19) of the rotor drive control units (4) for adjustment and checking thereof.

2. System according to claim 1, characterized in that the external means have a computer unit (20) with a communication interface (24) for connecting to one of the communication interfaces (18, 19) of the control units (4).

3. System according to claim 2, characterized in that the computer unit (20) is one of the following units: a notebook, a workstation, a microcontroller, a digital signal processor (DSP), a personal digital assistant (PDA) or a field programmable gate array (FPGA).

4. System according to claim 2, characterized in that the computer unit (20) comprises an application programme as means for substitute activation of the individual rotor drives (31) and for reading out signals from the individual control units (4) of the rotor drives (31) by means of the individual communication interfaces (18, 19) of the control units (4) and the communication interface (24) of the computer unit (20).

5. System according to claim 1, characterized in that the individual communication interfaces (18, 19) of the rotor drives (31) are configured as interfaces with a diagnostic interface as an integrated component thereof.

6. System according to claim 2, characterized in that the communication interface (24) of the computer unit (20) can be connected by means of a cable (22) to the communication interface (18, 19) of the control unit (4).

7. System according to claim 2, characterized in that the communication interface (18, 19) of the control unit (4) and the communication interface (24) of the computer unit (20) are configured as interfaces which can be wirelessly connected to one another.

8. System according to claim 7, characterized in that the communication interface (18, 19) of the control unit (4) and the communication interface (24) of the computer unit (20) are configured as infrared interfaces or radio interfaces.

9. System according to claim 1, characterized in that the communication interface (18, 19) of the control unit (4) is configured as a synchronous or asynchronous interface.

10. System according to claim 1, characterized in that the control unit (4) of the rotor drive (31) has a first communication interface (18) and a second communication interface (19), which are coupled to one another in such a way that on connection of the external computer unit (20) to the second communication interface (19), the first communication interface (18) can be deactivated.

11. System according to claim 1, characterized in that the respective workstation control units (34) are connected to a main control unit (1) by means of a bus system (32).

* * * * *